US005722602A

United States Patent [19]

Kelley

[11] Patent Number: 5,722,602

[45] Date of Patent: Mar. 3, 1998

[54] PROCESS FOR MAKING FLOWABLE POWDERS FOR COATING APPLICATIONS

[75] Inventor: Kurtis C. Kelley, Washington, Ill.

[73] Assignee: Caterpillar Inc., Peoria, Ill.

[21] Appl. No.: 573,158

[22] Filed: Dec. 15, 1995

[51] Int. Cl.[6] ..... B02C 23/18

[52] U.S. Cl. ..... 241/17; 241/21; 241/23

[58] Field of Search ..... 241/15, 17, 21, 241/23, 24.1

[56] References Cited

U.S. PATENT DOCUMENTS

| | | | |
|---|---|---|---|
| 3,881,661 | 5/1975 | Powers et al. | 241/15 |
| 3,972,480 | 8/1976 | Powers | 241/15 |
| 4,482,374 | 11/1984 | Osborn et al. | 241/17 X |
| 4,486,225 | 12/1984 | Osborn et al. | 241/17 X |
| 4,848,673 | 7/1989 | Masuda et al. | 241/23 X |
| 4,917,834 | 4/1990 | Hadermann et al. | 241/23 X |
| 4,934,609 | 6/1990 | Lindauer et al. | 241/23 X |
| 5,193,751 | 3/1993 | Mori et al. | 241/23 X |
| 5,203,512 | 4/1993 | Ferraris et al. | 241/15 X |
| 5,323,970 | 6/1994 | Tsutsui et al. | 241/23 X |
| 5,388,772 | 2/1995 | Tsau | 241/17 |
| 5,533,679 | 7/1996 | Golley | 241/17 |
| 5,556,038 | 9/1996 | Nakamura et al. | 241/17 |
| 5,593,490 | 1/1997 | Etheridge et al. | 241/15 X |

*Primary Examiner*—A. L. Pitts
*Assistant Examiner*—Julie A. Krolikowski
*Attorney, Agent, or Firm*—Pankaj M. Khosla

[57] ABSTRACT

A process for enhancing the flowability of a powder is disclosed. In this process, a powder of metal, ceramic, or mixtures thereof is mixed with polyvinyl alcohol. A paste of the powder-polyvinyl alcohol mixture is formed and dried. The dry paste is particulated and a flowable powder having a particle size the range of about 50 μm to about 300 μm is formed.

17 Claims, No Drawings

PROCESS FOR MAKING FLOWABLE POWDERS FOR COATING APPLICATIONS

TECHNICAL FIELD

The present invention relates generally to methods for altering powder flow characteristics, and more particularly to a process for making flowable powders for plasma spray coatings from single and multi-component powder mixtures having dissimilar particle size and density.

BACKGROUND ART

Plasma spray techniques are used to deposit wear resistant or thermally insulating coatings on various components in engines. For example, ceramic powders are plasma sprayed on the face of engine piston crowns and valves to deposit thermal barrier coatings on these components.

The plasma spray technique requires that a coating material be in a powder form, and the powder flow freely through a conduit to a plasma spray gun at a controlled feed rate. The plasma spray gun discharges the powder into a plasma flame at a controlled discharge rate to result in a plasma spray. If the powder does not flow freely, it results in a poor feed rate control to the plasma spray gun and consequently, a poor coating quality.

In most instances, plasma spray coatings are deposited from a multi-component powder mixture. The components often have different chemical properties, particle size and density. Thus, it is difficult to obtain a homogeneous mixture of a multi-component powder that is freely flowable through a conduit. It is also difficult to make a freely flowable powder out of single component powders where the particle size of the component is extremely small because the particles tend to agglomerate in a non-uniform manner.

Various methods for altering the powder flow characteristics are known to the plasma spray coatings industry. For example, the powder mixture can be passed through a sieve to obtain a powder with a narrower particle-size distribution and thus improve flowability. The powder may also be spray dried to agglomerate the powder into spherical particles which flow better. Unfortunately, spray drying is generally limited to fine particle size powder mixtures in which all of the mixture components are of similar size and density.

It has been desirable to have a process for improving the flowability of multi-component powder mixtures where the various powder components have significantly dissimilar density and particle size. It has also been desirable to have a process for improving the flowability of single component powders where the component has extremely small particle size, for example, in the nanometer size range.

The present invention is directed to overcome one or more problems of heretofore utilized methods for making a freely flowable powder mixture for plasma spray coating applications.

DISCLOSURE OF THE INVENTION

In one aspect of the present invention, a process for enhancing the flowability of a powder for spray coatings is disclosed. The process includes the following steps. A powder of metal, ceramic, or mixtures thereof is mixed with polyvinyl alcohol. A paste of the powder-polyvinyl alcohol mixture is formed. The paste is dried. The dry paste is particulated and a flowable powder having a particle size the range of about 50 μm to about 300 μm is formed.

BEST CASE FOR CARRYING OUT THE INVENTION

The terms "flowable", "freely flowable" and "flowability" as used herein are meant to describe a flow characteristic of a powder used for spray coating applications. A flowable powder flows freely through a conduit without the aid of additional flow enhancing steps such as fluidizing, for example. However, one skilled in the art may use known fluidizing techniques to further aid in the flowability of the powder. Likewise, one skilled in the art may use known gravity flow methods to aid in the flowability of the powder.

In the preferred embodiment of the present invention, a process for enhancing the flowability of a powder for spray coatings includes the steps of mixing a metal, ceramic, or mixtures thereof powder with polyvinyl alcohol, forming a paste of the powder-polyvinyl alcohol mixture, drying the paste, particulating the dry paste, and forming a flowable powder having a particle size in the range of about 50 μm to about 300 μm.

In the preferred embodiment of the present invention, the process also includes the step of passing the particulated dry paste through a sieve having a mesh size desirably, in the range of about 50 to about 200, even more desirably, in the range of about 80 to about 120, and preferably, about 100 mesh size. Passing of the particulated dry paste through a mesh size larger than about 50, i.e., say about 45 for example, is undesirable because the mesh bottoms would include particles that would have a size greater than about 300 μm which would not flow too well, and if fed to a plasma gun, would detrimentally affect the coating quality. Passing of the particulated dry paste through a mesh size smaller than about 200, i.e., say about 250 for example, is undesirable because the mesh bottoms would include particles that would have a size smaller than about 50 μm, which would again not flow too well, would tend to clump up together and thus detrimentally affect the coating quality.

In the preferred embodiment of the present invention, the polyvinyl alcohol (PVA) is an aqueous solution of PVA and water. The PVA is present in the aqueous solution in an amount desirably, no greater than 20% by weight of water, even more desirably, no greater than 10% by weight of water and preferably, about 5% by weight of said water. A PVA-water solution having greater than 20% PVA is undesirable because the excess PVA would have to be ignited when the plasma powder is introduced into a plasma flame and this will detrimentally affect coating quality. Further from environmental concerns, the least amount of PVA that has to be flashed off into the atmosphere must be used. About a 5% PVA in water solution is preferred because it represents an amount of PVA suitable for most powders used for plasma spray applications, in terms of its ability to coat the surface area of such powders and make the resultant powder free flowing.

In the preferred embodiment of the present invention, the powder and the PVA-water solution are mixed in a weight ratio ranging desirably, from about 100 parts powder to 1 part PVA-water, to about 100 parts powder to 1000 parts PVA-water. Preferably, the weight ratio ranging from about 100 parts powder to 5 parts PVA-water, to about 100 parts powder to 500 parts PVA-water. A weight ratio of powder:PVA greater than 1:0.01 is undesirable because the PVA will not be present in an amount sufficient to impart any surface modification characteristics to the powder particles or bond particles together to form micro agglomerates that are essential to make the powder flowable. A weight ratio of powder:PVA less than 1:10 is undesirable because the PVA will be present in too large a quantity and will detrimentally affect the coating during plasma spray by flashing off and igniting during deposition.

In the preferred embodiment of the present invention, the powder and PVA-water solution are mixed to a paste desirably having a dough-like consistency. Preferably, the paste is a homogeneous paste. A paste of dough like consistency is desirable because the paste must be thick enough to contain only a minimum amount of solution, so that all the powder particles are fully wetted but that no solution separates from the mixture after the paste is allowed to sit in a container. If the paste is too wet, the PVA-water solution will rise to the surface of the paste and form a thin PVA crust over it. When dried and pulverized, this PVA crust can detrimentally affect the coating quality when the powder is fed to a plasma spray gun and coated. Also, if the paste is too wet, separation of the powder mixture components occurs due to chemical and density dissimilarities caused by the lubricating effect of excess water between the powder grains. If the paste is too dry, adequate surface wetting of all particles will not occur, detrimentally affecting the flowability of the resultant powder.

In the preferred embodiment of the present invention, the paste is dried at a temperature no greater than about 85° C. Desirably, the paste is dried at a temperature in the range of about 50° C. to 85° C., and preferably, at about 80° C. A drying temperature less than about 50° C. is undesirable because it would result in too long a drying time and represent a waste of time. A drying temperature greater than about 85° C. is undesirable because the PVA, which has a boiling point of about 85° C., would start boiling and detrimentally evaporate from the paste, thus reducing the free flowability of the powder.

In the preferred embodiment of the present invention, the dry paste is particulated to form a flowable powder having a particle size desirably, in the range of about 75 μm to about 250 μm, even more desirably, in the range of about 100 μm to about 200 μm, and preferably, about 150 μm. A particle size less than about 75 μm is undesirable because the particles would be too small and would not flow too well in a plasma spray equipment, such as a conduit feeding the plasma spray powder mixture to a gun, for example. A particle size greater than about 250 μm is not desirable because the particles would bee too large and would not be suitable for injection into a plasma flame, thus detrimentally affecting coating quality.

The following Examples are provided to further illustrate the preferred embodiments of the process of the present invention.

EXAMPLE A

In one coating application, a homogeneous powder mixture of iron and carbon was required to be fed to a plasma spray gun. This was heretofore particularly difficult because the density and particle size of iron and carbon are vastly different. For example, the particle size of iron was in the range of 30 μm to 50 μm whereas the particle size of carbon was in the range of 0.5 μm to 1 μm. Further, amorphous carbon powder has a density of about 2 gms/cc whereas crystalline iron powder has a density of about 7.9 gms/cc. The very fine sized carbon particles would heretofore tend to clump together and the iron particles would rapidly oxidize in water.

According to one embodiment of the present invention, a mixture of 5000 gms iron powder and 150 gms carbon powder was first mixed with a 2% by weight solution of Chemcrest 77C® in water and 1 cc of Darvan C®. Chemcrest 77C® is an aqueous amine based rust inhibitor and is manufactured by Chemcrest Co., and added to inhibit corrosion of the iron. Darvan C® is polymethacrylate dispersant and is added to aid in dispersing the carbon. To this iron-carbon mixture, was added 500 gms of a 5% PVA solution in water. The mixture was mixed well to form a thick paste having a dough-like consistency. The paste was dried in an oven at 80° C. The dried paste was crushed and sieved through a 100 mesh size screen. The resultant powder was essentially a carbon coated iron powder that was freely flowable.

EXAMPLE B

In another coating application, a free flowing very fine nanometer sized aluminum oxide powder was required to be fed to a plasma spray gun. This was heretofore particularly difficult because of the extremely fine particle size in the range of 15 to 30 nanometers (0.015 μm to 0.03 μm), which would cause the $Al_2O_3$ powder to clog the plasma spray gun.

According to another embodiment of the present invention, 5000 gms $Al_2O_3$ powder were mixed with 15,000 gms of a 5% PVA solution in water. The mixture was subjected to the same process steps as outlined in Example A. The resultant powder was a free flowing $Al_2O_3$ powder having an agglomerate particle size less than about 150 μm.

Industrial Applicability

The present invention is useful for making freely flowable powders for plasma spray coatings from single and multi-component powder mixtures having dissimilar particle size and density. This invention is particularly useful for improving the flowability of mixtures of amorphous powders and crystalline powders, for example, which have vastly dissimilar surface tension and wettability properties, density, and particle size. The freely flowable powders made by the process of the present invention can be used to feed a plasma spray gun, with a significant improvement in powder compositional and flow rate consistency, resulting in higher quality coatings.

Other aspects, objects and advantages of this invention can be obtained from a study of the disclosure and the appended claims.

I claim:

1. A process for enhancing the flowability of a powder for spray coatings, comprising the steps of:

mixing a metal, ceramic, or mixtures thereof powder with an aqueous solution of polyvinyl alcohol and forming a powder-polyvinyl alcohol mixture;

forming a paste of said powder-polyvinyl alcohol mixture;

drying said paste at a temperature in the range of 50 degrees C. to 85 degrees C.; and particulating said dry paste and forming a flowable powder having a particle size in the range of about 50 μm to about 300 μm.

2. A process as set forth in claim 1, including the step of passing said particulated dry paste through a sieve having a mesh size in the range of about 50 to 200.

3. A process, as set forth in claim 2, wherein said particulated dry paste is passed through a sieve having a mesh size in the range of about 80 to about 150.

4. A process, as set forth in claim 3, wherein said particulated dry paste is passed through a sieve having a mesh size in the range of about 80 to about 120.

5. A process, as set forth in claim 4, wherein said particulated dry paste is passed through a sieve having a 100 mesh size.

6. A process, as set forth in claim 1, wherein said polyvinyl alcohol is present in said aqueous solution in an amount no greater than 20% by weight of water.

7. A process, as set forth in claim 6, wherein said polyvinyl alcohol is present in said aqueous solution in an amount no greater than 10% by weight of water.

8. A process, as set forth in claim 7, wherein said polyvinyl alcohol is present in said aqueous solution in an amount of about 5% by weight of water.

9. A process, as set forth in claim 1, wherein said powder and said polyvinyl alcohol are mixed in a weight ratio ranging from about 1:0.01 to about 1:10, powder:polyvinyl alcohol.

10. A process, as set forth in claim 9, wherein said powder and said polyvinyl alcohol are mixed in a weight ratio ranging from about 1:0.05 to about 1:5, powder:polyvinyl alcohol.

11. A process, as set forth in claim 1, wherein said powder and polyvinyl alcohol are mixed to a paste having a dough-like consistency.

12. A process, as set forth in claim 1, wherein said powder and polyvinyl alcohol are mixed to form a homogeneous paste.

13. A process, as set forth in claim 1, wherein said paste is dried at a temperature no greater than about 85° C.

14. A process, as set forth in claim 13, wherein said paste is dried at a temperature in the range of about 50° C. to 85° C.

15. A process, as set forth in claim 14 wherein said paste is dried at a temperature of about 80° C.

16. A process, as set forth in claim 1, wherein said dry paste is particulated to form a flowable powder having a particle size in the range of about 75 μm to about 250 μm.

17. A process, as set forth in claim 16, wherein said dry paste is particulated to form a flowable powder having a particle size in the range of about 100 μm to about 200 μm.

* * * * *